US007313226B1

(12) United States Patent
Falce et al.

(10) Patent No.: US 7,313,226 B1
(45) Date of Patent: Dec. 25, 2007

(54) SINTERED WIRE ANNODE

(75) Inventors: Louis R. Falce, Surprise, AZ (US); R. Lawrence Ives, Saratoga, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 0 days.

(21) Appl. No.: 11/226,659

(22) Filed: Sep. 14, 2005

Related U.S. Application Data

(63) Continuation-in-part of application No. 11/085,425, filed on Mar. 21, 2005.

(51) Int. Cl.
*H01J 35/08* (2006.01)

(52) U.S. Cl. ..... 378/143; 378/144

(58) Field of Classification Search ..... 378/143, 378/144

See application file for complete search history.

(56) References Cited

U.S. PATENT DOCUMENTS

| | | | | |
|---|---|---|---|---|
| 4,103,198 | A | 7/1978 | Braun | 378/125 |
| 4,145,628 | A | 3/1979 | Iwasaki | 378/144 |
| 4,145,632 | A | 3/1979 | Devine | 378/144 |
| 4,165,472 | A | 8/1979 | Wittry | 378/127 |
| 4,920,551 | A | 4/1990 | Takahashi | 378/125 |
| 4,958,364 | A | 9/1990 | Guerin et al. | 378/144 |
| 4,991,194 | A | 2/1991 | Laurent et al. | 378/144 |
| 5,451,831 | A * | 9/1995 | Lee | 313/346 R |
| 5,943,389 | A | 8/1999 | Lee | 378/144 |
| 6,269,146 | B1 | 7/2001 | Ohnishi et al. | 378/130 |
| 6,430,264 | B1 | 8/2002 | Lee | 378/144 |
| 6,560,315 | B1 | 5/2003 | Price et al. | 378/144 |
| 6,707,883 | B1 | 3/2004 | Tiearney et al. | 378/144 |
| 6,735,281 | B2 | 5/2004 | Ohnishi et al. | 378/132 |
| 2002/0154741 | A1 * | 10/2002 | Rigali et al. | 378/144 |

* cited by examiner

*Primary Examiner*—Courtney Thomas
(74) *Attorney, Agent, or Firm*—Jay A. Chesavage; File-EE-Patents.com

(57) ABSTRACT

A plurality of high atomic number wires are sintered together to form a porous rod that is parted into porous disks which will be used as x-ray targets. A thermally conductive material is introduced into the pores of the rod, and when a stream of electrons impinges on the sintered wire target and generates x-rays, the heat generated by the impinging x-rays is removed by the thermally conductive material interspersed in the pores of the wires.

14 Claims, 4 Drawing Sheets

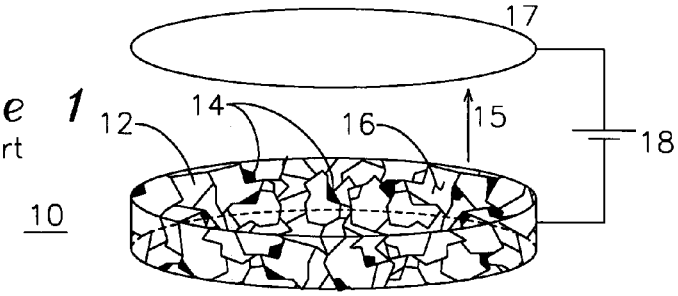
*Figure 1*
Prior Art
*Figure 2a*
Prior Art
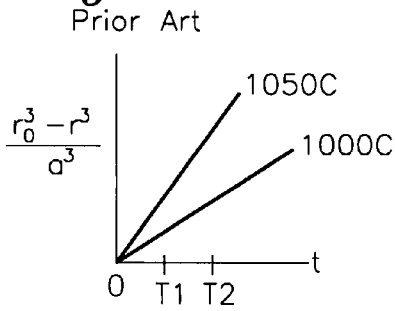
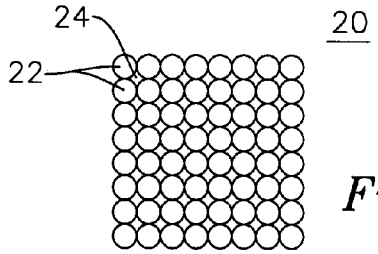
*Figure 2b*
Prior Art
t=0
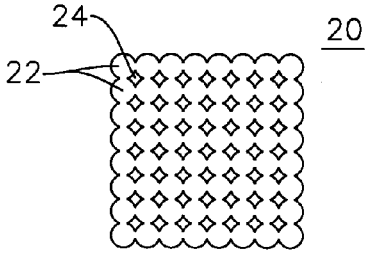
*Figure 2c*
Prior Art
t=T1
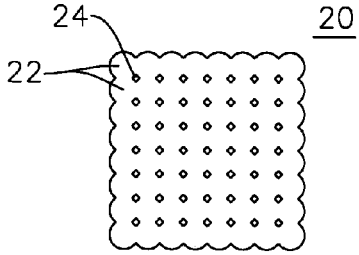
*Figure 2d*
Prior Art
t=T2

Section a–a

Section a–a

Section a–a

SINTERED WIRE ANNODE

This application is a continuation-in-part of pending application Ser. No. 11/085,425 filed on Mar. 21, 2005.

This invention was made with United States government support under Grant DE-FG-03-04ER83918 from the United States Department of Energy. The United States Government has certain rights in this invention.

FIELD OF THE INVENTION

The present invention is related to porous cathode structures for use with microwave tubes, linear beam devices, linear accelerators, cathode ray tubes, x-ray tubes, ion lasers, and ion thrusters. More particularly, it is related to a dispenser cathode which is fabricated from a plurality of wires which are sintered into a porous cathode structure which is then parted into a porous cathode disk. The dispenser cathode is formed by bonding the porous cathode disk to a cathode enclosure proximal to both a heater and a source of work-function reducing material such as BaO, CaO, or $Al_2O_3$, which migrates through the pores of the porous cathode disk.

BACKGROUND OF THE INVENTION

In the prior art, the emitting surface of a dispenser cathode is made from either porous metal matrices whose pores are filled with electron emitting material or porous metal plugs or perforated foils covering reservoirs of electron emitting material. The porous metal matrices and porous metal plugs exhibit a random porosity without consistently uniform pore size, pore length, or spacing between the pores on the surface. The electron emission is related to the surface work function reducing material trapped in the pores, which are of variable size and spacing. Accordingly, dispenser cathodes of the prior art do not have uniform surface electron emission.

FIG. 1 shows a prior art powdered tungsten sintered cathode 10. Tungsten powder grains 12 are sorted to a range on the order of 10 u and are compressed and sintered under elevated temperature to form a cathode 10 comprising a porous tungsten matrix. The matrix structure is then impregnated with a surface work function reduction material 30, such as BaO, CaO, and $Al_2O_3$. When operated as an electron source in a microwave gun, the cathode is heated to a temperature of approximately 1000° C. and a voltage 18 is applied between the cathode 16 and anode 17, which is shown as a conductive plate for simplicity. The impregnate work function reducing material (not shown) migrates through the pores 14 to the emission surface 16 and lowers the work function for electron emission, thereby improving the yield of free electrons 15. The voltage 18 is applied with sufficient potential for free electrons in the tungsten to overcome the surface work function voltage and be accelerated from the surface 16 to the anode 17. Ideally, the electron emission from cathode 16 should be uniform, however this is limited by the uniformity of deposition of work function reducing material through the cathode, which typically has irregular porosity, as was earlier described.

Others have proposed processes for manufacturing controlled porosity cathodes. In U.S. Pat. No. 4,379,979, Thomas and Green describe a technique using silicon and metal deposition. This process starts with a generally flat silicon template substrate structure having and array of upstanding microposts 1-25 microns across on 5-10 micron spacings from each other. A layer of metal is then deposited on the substrate to surround the microposts and cover the substrate to a desired depth. The metal layer is abraded to a smooth, flat surface which exposes the microposts. Thereafter, the silicon substrate and microposts are completely etched away, leaving a metal sheet having micron-size holes throughout. This technique is applicable to small, flat cathodes. It contains a number of process steps which limit both the size and configurations that can be obtained. The thickness of the cathode material is approximately 100 microns. This technique would not be applicable to large cathodes where differential thermal expansion could cause the material to buckle or warp.

In U.S. Pat. No. 4,587,455, Falce and Breeze describe a process for creating a controlled porosity dispenser cathode using laser drilling. In this process, a configured mandrel is coated with a layer of material such as tungsten so that when the mandrel is removed from the coating material a hollow housing is formed having a side wall and an end wall which define a reservoir. Thereafter an array of apertures is formed in the end wall of the housing by laser drilling to create an emitter-dispenser, but this method is only applicable to small cathodes, as the laser drilling process becomes unmanageable for large cathodes where millions of holes would be required. Also, the thin coating which forms the emitter is subject to warping and buckling from differential expansion of the coating and the support structure.

In U.S. Pat. No. 4,745,326, Green and Thomas describe a controlled porosity dispenser cathode using chemical vapor deposition and laser drilling, ion milling, or electron discharge machining for consistent and economical manufacture. This process is also more applicable for small cathodes where the number of laser drilled holes are manageable. This process also includes a large number of separate sequential processes to obtain the final cathode and can not provide cathode emitting surfaces of arbitrary thickness.

In U.S. Pat. No. 5,118,317, Wijen describes a process that uses an array of porous, sintered structures where the powder particles are coated with a thin layer of ductile material. Since this process begins with particles containing a distribution of sizes, there is no direct control of the porosity through the entire structure.

U.S. Patent Application 2002/0041140 by Rho, Cho, and Yang describes a process for oxide cathodes that controls the porosity and electron emission. This process is only applicable to oxide cathodes which are fundamentally different from the dispenser type of the present invention.

One application for the sintered wire process is the fabrication of X-ray anodes, which are typically formed from high atomic number metals such as tungsten or molybdenum, and form x-rays as secondary particles resulting from the collision of high energy electrons into a target surface. The electrons are accelerated from an electron gun at a large negative potential with respect to an anode, and the target anode is often at an angle to the incoming electron trajectory. This target angle encourages the secondary particles and x-rays to exit the x-ray target and pass through an aperture in the housing surrounding the X-ray tube, thereby forming an x-ray source.

FIG. 6*a* shows a prior art fixed anode X-ray tube 64, which comprises a heated cathode 66, an evacuated chamber (not shown), and a high thermal conductivity substrate 68, which includes a surface 65 which is formed from a material having a high melting temperature such as tungsten, molybdenum, tantalum, niobium, or any material with a high atomic number and associated high melting temperature compared to the high thermal conductivity substrate 68. In the prior art of x-ray tubes, the size of the x-ray target and density of the electron beam 67 is limited by the thermal conductivity of the target material and the heat load delivered to the x-ray 69 producing surface material 65.

FIG. 6*b* shows a rotating target prior art x-ray tube 70, where the heated cathode 78 generates an electron stream 79 which may be focused on a rotating surface 74, where the rotation is governed by a motor 72 which may be outside of the evacuated envelope (not shown). The substrate 76 may be comprised of a thermally conductive material such as copper, silver, gold, or graphite, which has applied on its surface a thin layer of x-ray 80 producing material 74 which may be tungsten, or molybdenum or any material or alloy suitable for the production of x-rays.

In the prior art, there is no control of the size and distribution of the pores 14 over the cathode surface 16. This results in non-uniform distribution of the work function reducing impregnate over the surface 16. In a dispenser cathode, a longer cathode lifetime is accomplished by maintaining a reservoir of work function reducing material behind a porous cathode having an emission surface, where the uniform porosity of the cathode expresses the work function reducing material to the emitting surface, resulting in a cathode with long emission times. Until the present invention, it has not been possible to fabricate a uniformly porous cathode of variable diameter or thickness for this purpose.

It is desired to provide a uniform porosity tungsten cathode which may be used as a dispenser cathode having an emission surface and a dispenser surface adjacent to a source of work function reducing material. It is also desired to provide a method for the fabrication of a uniform porosity cathode. It is also desired to provide a porous cathode structure having uniform porosity where such porosity is invariant through the structure, such that many cathodes of arbitrary thickness may be formed from the structure.

FIG. 2*a* shows two generalized sintering progression curves for sintered copper wires at the copper sintering temperatures 1000° C. and 1050° C., where the progression of sintering is measured by the closing of pores over time as described in "Fundamental Principles of Powder Metallurgy" by W. D. Jones, Edward Arnold Publishers, London, 1960. The sintering progression is expressed in the metric $(r_0^3-r^3)/a^3$, where $r_0$ is the initial effective radius of the pore r is the effective radius of the pore at time t a is the initial radius of the wire.

The progression of time and temperature reduces the pore size as shown in FIGS. 2*b* through 2*d*. FIG. 2*b* shows the initial condition for time t=0 where the sintered structure 20 comprises a plurality of copper wires 22, with initial pores 24 formed by the spaces between the wires 22. After application of a sintering temperature T such as 1000° C. for copper wires for a time t=T1, the pores 24 begin to close as the wires 22 sinter together, as shown in FIG. 2*c*. At a final time t=T2 shown in FIG. 2*d*, the pores 24 have further closed as the wires sinter together to form a continuous porous structure. By careful selection of sintering time and pressure, the desired porosity may be achieved in the cathode structure 20.

Sintering of copper wires in the prior art has been used principally to develop sintering models and to understand the sintering process for particles, which are treated in the limit as spheres, and has not been used to form continuously porous structures, such as would be used for dispenser cathodes for electron emission.

Devices using electron beams may generate these beams using dispenser cathodes. These porous cathodes are impregnated with material designed to lower the work function at the cathode surface. The cathode is heated to approximately 1000° C. and the impregnate migrates through the pores in the tungsten to the surface. Problems occur when the distribution of pores varies across the cathode surface, leading to nonuniform migration of the impregnate. When this occurs, there is a variation in emission of electrons caused by the variation in work function. This is particularly troublesome for cathodes operating in a regime where the emission is dependent on the temperature. In these circumstances, the emission variation can vary greatly over the surface.

In addition to the fabrication of cathodes for use in electron tubes, other additional applications for sintered wire rods may be envisioned. One such application is the use of targets to generate secondary particles such as X-rays from high energy collisions, where the target for the high energy electrons or other particles naturally accumulates large amounts of thermal energy from such collisions, compared to the energy of the released x-rays, and the heat must be removed to prevent melting of the target. In one such application, x-ray targets are formed from high melting point metals such as tungsten or molybdenum, which form the anode of an x-ray generating device. Presently, the start of the art for x-ray tube anode thermal control involves concentrating the incoming electron beam on a small part of the tungsten anode, and rotating a large area of target anode through the electron impingement region, such that the active target area is heating while other parts of the rotating anode are drawing thermal energy from the region of impingement.

Rotating anode x-ray sources are described in U.S. Pat. Nos. 4,165,472 by Wittry, 4,920,551 by Takahashi et al, 4,958,364 by Guerin et al, 4,991,194 by Laurent et al, 6,560,315 by Price et al, and 6,735,281 by Ohnishi et al. U.S. Pat. No. 6,430,264 by Lee describes the use of carbon fibers in a rotating anode for improved thermal conductivity from a tungsten target to the underlying substrate.

U.S. Pat. No. 5,943,389 by Lee describes an x-ray target comprising a substrate which is coated with perpendicularly oriented high thermal conductivity fibers, whereafter a layer of high atomic number x-ray producing material is applied.

OBJECTS OF THE INVENTION

A first object of the invention is a uniform porosity cathode structure, which may be fabricated from tungsten wire.

A second object of the invention is a method for making a uniform porosity cathode.

A third object of the invention is a porous dispenser cathode.

A fourth object of the invention is a process for making a porous dispenser cathode.

A fifth object of the invention is a target for the generation of x-rays and other secondary particles whereby in a first step, the target is fabricated from any of a variety of a high atomic number materials available in wire form, whereby a plurality of high atomic number wires, formed from materials such as tungsten or molybdenum, are sintered into a rod, and in a second step, the rod is parted into a plurality of porous sintered wire discs, and in a third step, a high thermal conductivity material such as copper is introduced into the pores surrounding the sintered metal wire discs.

A sixth object of the invention is a porous tungsten x-ray target formed from sintered tungsten wires whereby copper is added to the porous regions after sintering.

A seventh object of the invention is a process for manufacturing a sintered wire x-ray target whereby a rod is formed from sintered wire and thereafter a high thermal conductivity material is added, either before or after parting the rod into smaller segments.

SUMMARY OF THE INVENTION

The present invention describes a technique which allows for controlled, uniform distribution of pores over the entire cathode surface. The technique does not require that the emission material be impregnated, but instead uses a reservoir of work function reducing material below the surface that can provide substantially improved cathode lifetime before the impregnate is depleted. The precise control of both the pore size and uniform electron distribution will allow custom design of the cathode for specific applications.

It is the primary object of the present invention to provide a method for fabricating a dispenser cathode having a uniform surface porosity so that uniform electron emission can be achieved.

To produce a porous matrix the prior art used tungsten powder with a particle size distribution that varied from sub micron diameter particles to particle diameters up to 15 microns. The resultant matrices had pores with varying diameter, length and spacing between pores at the surface. This was the case with either the impregnated matrices or the porous plugs covering a reservoir.

The present invention uses small diameter tungsten wires having a fixed diameter selected from the range of 10 and 20 microns. These fixed diameter wires are sintered together in such a way to produce a porous material with pores which are parallel to the wires and uniformly spaced between the wires. This is accomplished by placing the wires in intimate contact and restrained so that when sintered at temperatures between 2300° C. and 2500° C., a metallurgical phenomenon known as "necking" will fuse the wires together and a series of uniform voids will occur between the contact points. Under natural compaction, these voids will be uniformly spaced around the periphery of the wires every 60 degrees.

The process can be used to control the size of the pores, which can affect the rate of migration of the impregnate, and the distribution of the pores over the surface. The size and distribution of the pores can be optimized based on the application of the cathode to improve the operating characteristics, including the cathode emission density and lifetime.

BRIEF DESCRIPTION OF THE DRAWINGS

FIG. 1 is a perspective view of a prior art cathode fabricated by sintering a powder of tungsten and impregnated with a work function reducing material.

FIG. 2*a* is a graph of pore volume change versus sintering time.

FIG. 2*b* is the section view of a prior art sintered wire structure at initial time t=0.

FIG. 2*c* is the section view of a prior art sintered wire structure at time t=T1.

FIG. 2*d* is the section view of a prior art sintered wire structure at time t=T2.

DETAILED DESCRIPTION OF THE INVENTION

Figure 3A:
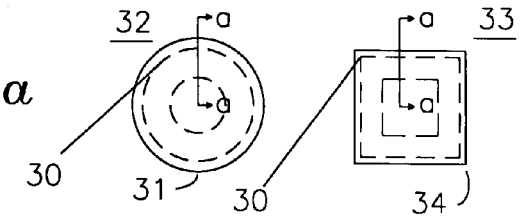
FIG. 3*a* shows a cylindrical and a rectangular spool used to gather wires into a sintering geometry.
Figure 3B:
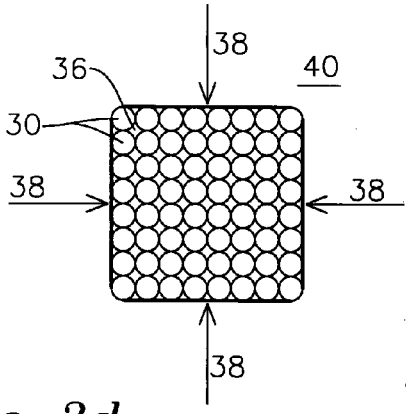
FIG. 3*b* shows a section view of FIG. 3*a* in a sintering structure at initial time t=0.

FIG. 3*a* shows a round bobbin 31 having tungsten wire 30 wound around it, or alternatively a square bobbin 33 having been wound with tungsten wire 30. The wire 30 may be formed from any material or diameter, however it is believed that tungsten wire with a fixed diameter in the range 10-20*u* is preferred for porous dispenser cathodes. Tungsten wire in this diameter range is commonly available for use in electro-discharge machining (EDM) and is also used as a source material for fabricating the filament of an incandescent light bulb. When wound about a square 34 or circular 31 bobbin, the cross section a-a of a bundle of such tungsten wires appears as shown in FIG. 3*b*. While the axial wire 30 tension from winding on the bobbin naturally causes a radial confining force, it may be desired to supplement this tensile force with external confining force 38 to enable uniform wire 30 packing during sintering. The porous cathode structure is formed from a plurality of sintered tungsten wires where straight pores of controlled size exist through the structure. The process for manufacturing the material begins with bundles of wires formed on the bobbins of FIG. 3*a*, which are shown in section a-a in FIG. 3*b*. The bundle of tungsten wires 30 are closely packed such that there are uniform gaps, or pores 36 around the periphery of each wire. The length of the wires can be arbitrary and chosen for compatibility with the manufacturing equipment or final application.

Figure 3C:
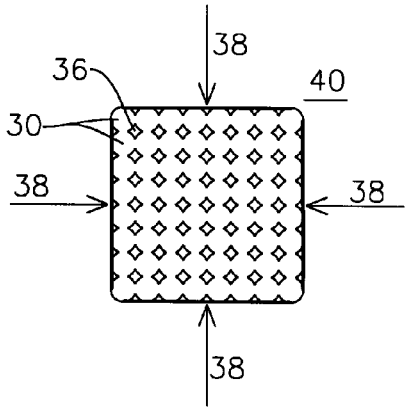
FIG. 3*c* shows the structure of FIG. 3*b* at intermediate time t=T1.
Figure 3D:
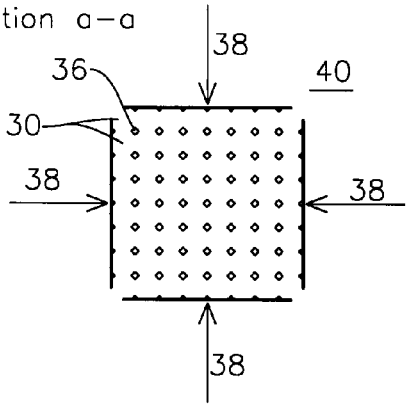
FIG. 3*d* shows the structure of FIG. 3*b* at final time t=T2.
Figure 4:
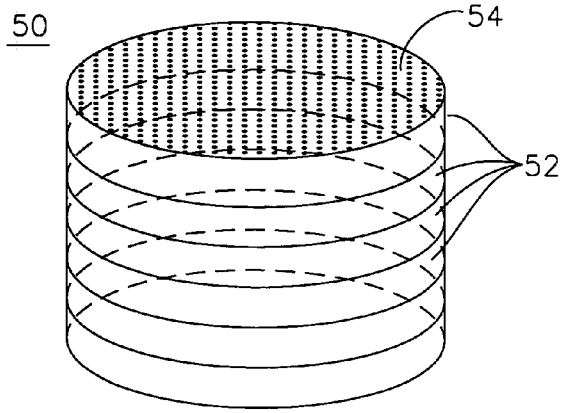
FIG. 4 shows the porous cathode structure of FIG. 3*d* cut into a plurality of sintered wire disks.

FIG. 3*c* shows the intermediate state and FIG. 3*d* shows the final sintered cathode structure 40, and after removal from the bobbin 31 or 34 of FIG. 3*a*, is shown formed in to the cylindrical porous cathode structure 50 of FIG. 4. The resulting sintered cathode structure 50 has a desired porosity based on the tungsten wire diameter as well as the sintering parameters of time and temperature. As shown in FIG. 4, the porous cathode structure 50 may then be cut into several porous cathodes 52, since the pores of the structure run axially through the cathode structure 50. Since the porous cathode is structurally integral, it is possible to separate the individual cathodes 52 using means such as EDM or mechanical cutting. The ease of separating these cathode disks 52 stands in contrast to prior art bulk cathodes sintered from particles of tungsten, where the prior art sintered particle cathode requires copper infusion into the pores to provide sufficient mechanical strength for any subsequent machining operations. The integral structure of sintered tungsten 50 provides internal mechanical strength to allow machining operations directly on the porous cathode structure 50, and the resulting individual porous cathodes 52 may be machined to create an electron emission surface which is planar, concave, or any shape desired from the prior art of cathode emission surface profiles.

Figure 5A:
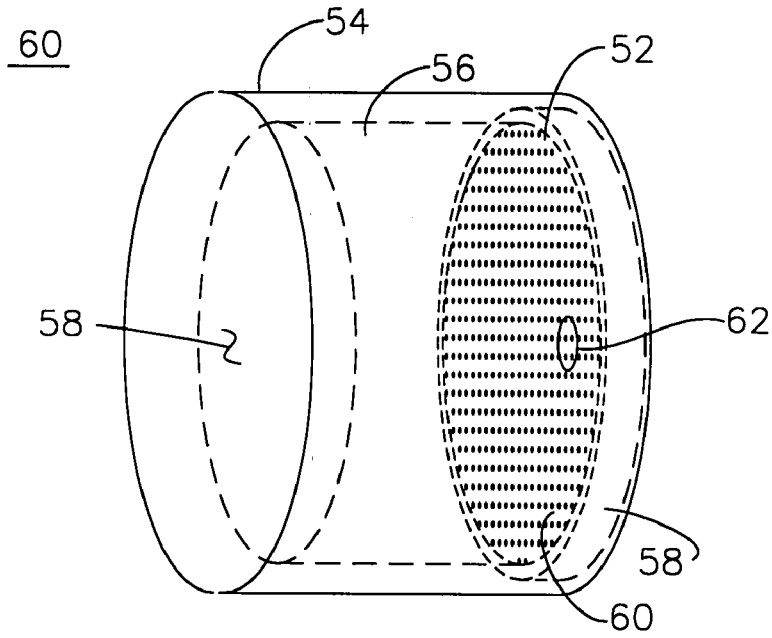
FIG. 5*a* shows a perspective view of a sintered wire cathode assembly.
Figure 5B:
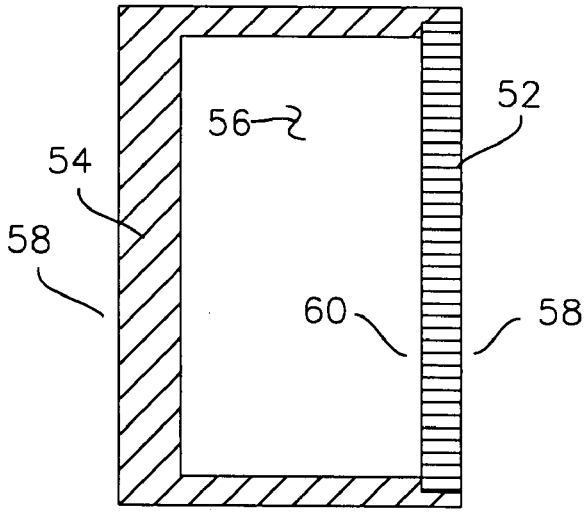
FIG. 5*b* shows a section view of the sintered wire cathode assembly of FIG. 5*a*.
Figure 6A:
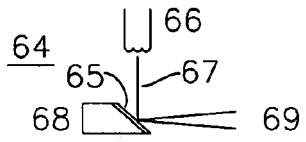
Figure 6a Prior Art
FIG. 6*a* shows a prior art fixed anode X-ray tube.
Figure 6B:
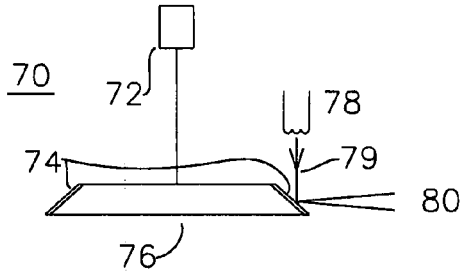
Figure 6b Prior Art
FIG. 6*b* shows a prior art rotating anode x-ray tube.

FIG. 5*a* shows a dispenser cathode assembly 60 including a porous cathode 52 fabricated according to the present invention. The porous cathode 52 is cut from the cathode structure of FIG. 4, and is placed in dispenser cathode support 54, which also has formed a cavity 56 for enclosing a work function reducing material (not shown), which may be any of the known work function reducing materials BaO, CaO, and $Al_2O_3$, or any alternate material known to reduce the free electron work function for an electron emitting cathode 52. FIG. 5*b* shows a section view of the cathode of FIG. 5*a*. Porous cathode 52 has an electron emission surface 58 and a work function replenishment surface 60. The dispenser cathode support 54 is placed adjacent to a heat source on surface 58 which heats the porous cathode 52 and causes migration of the BaO, CaO, and $Al_2O_3$ mixture in cavity 56 through cathode 52 pores 62 to the emitting surface 58 where electrons are emitted when an accelerating potential (not shown) is applied to the dispenser cathode assembly 60. The uniform distribution of pores 62 provides uniform distribution of the impregnate over the emission surface 58. The emission surface 58 may be planar or concave, or any shape known in the art of cathode emission surfaces.

Many variations of the invention may be practiced within the scope of the specification herein. For example, the porous cathode may be fabricated from alternate materials other than tungsten, and a heterogeneous mixture of wire diameters may be concurrently wound to produce a variety of pore spacings and patterns. Any of the refractory metals used in cathode prior art may be formed into wires which can then be sintered into a cathode structure as described in the present invention. In the prior art of powdered sintered cathodes, the work function material was placed in the sintered matrix. In the present invention, the work function material may be coated on the wire prior to sintering, such that the work function material is loaded into the cathode after sintering, or as described in the drawings, the work function material may be placed in a cavity behind the electron emission surface of the porous cathode 52, as shown in FIGS. 5*a* and 5*b*.

Figure 7A:
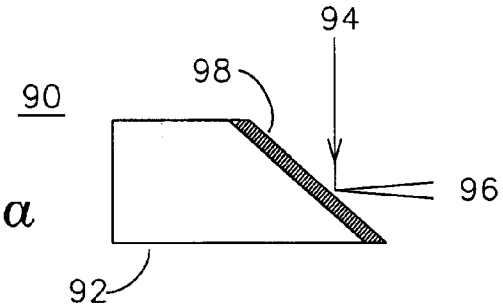
FIG. 7*a* shows a sintered wire x-ray target for use with a fixed anode X-ray tube.

FIG. 7*a* shows the porous surface 98 such as was formed as a porous disk 52 from the porous rod 54 of FIG. 4. The porous disk 52 of FIG. 4 may further include the introduction of copper or a high conductivity material into the pores of the disk 52, or the pores of the disk 52 may be filled with any material which provides thermal conductivity and optionally enhances bonding of the porous surface 98 to the anode substrate 92 in FIG. 7*a*. As described earlier, high energy electrons 94 impinge on the x-ray forming surface 98 to generate the x-ray pattern 96.

Figure 7B:
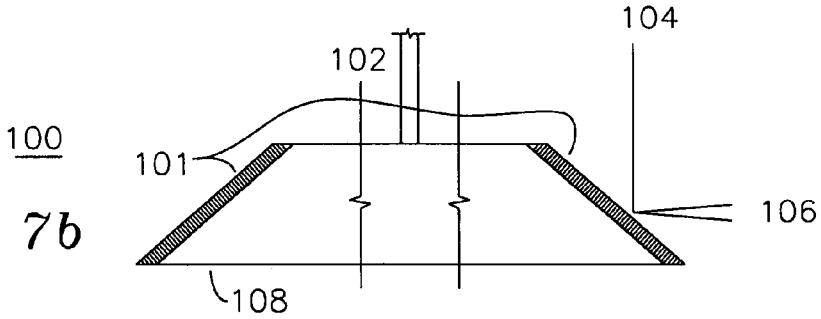
FIG. 7*b* shows a sintered wire x-ray target for use with a rotating anode x-ray tube.

FIG. 7*b* shows the same porous disk 101 applied to a rotating anode substrate 108 coupled to shaft 102, where the substrate 108 may be any thermally conductive material known in the prior art of x-ray anode substrates, including copper, graphite, stainless steel, nickel, cupronickel, or monel.

The target surface 98 of FIG. 7*a* and target surface 101 of FIG. 7*b* show a sintered wire surface suitable for use as an x-ray target. The target surface 98 and 101, respectively, comprise a plurality of sintered wires formed into a disk, or into any other shape which is suitable for use as a target according to the prior art. The sintered wire target may be substituted for prior art targets in any of the forms described in the prior art patents, or as used in the prior art, including targets which are stationary or rotating. The enhanced thermal conductivity of the porous target surface 98 and 101 increases thermal conductivity of the target, thereby providing an improved target surface.

The sintered wires may be formed as described earlier, whereby the wires are held together with an axial pressure, and sintered until a suitable level of sintering occurs, as was described in FIGS. 3*a*, 3*b*, and 3*c*, and forms the sintered rod shown in FIG. 4. The porous rod 54 can then be cut into porous discs 52 for use as targets, and the discs are then immersed into a pool of liquid copper, or copper may be introduced by heating the disc in the presence of copper liquid or in any gaseous or aqueous form, and the copper may be drawn into the pores of the sintered disc such as by capillary action. In this manner, a high thermal conductivity target may be fabricated.

Figure 8:
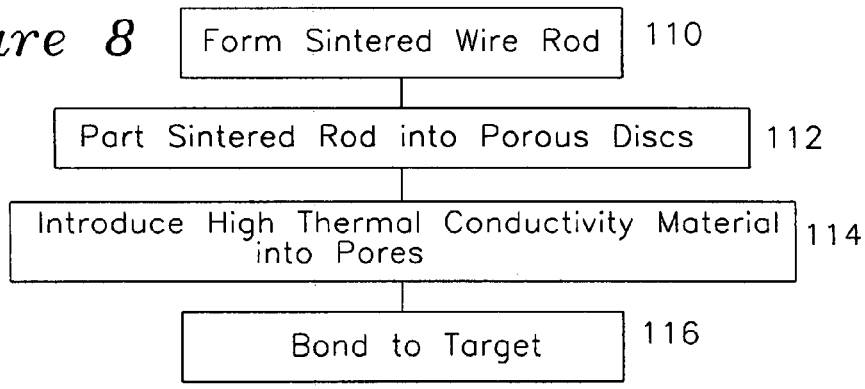
FIG. 8 shows a process flowchart for fabricating a sintered wire x-ray target.

There are alternate methods for fabricating a sintered wire x-ray target surface using the process described, and these include changing the steps of the process or order of the steps, such that the introduction of the copper may be done prior to the cutting of the sintered wires into discs, or alternate materials other than tungsten and copper may be used for the target and thermal conductive wick, respectively. One possible process is shown in the steps of FIG. 8, whereby a first step of forming a sintered wire rod such as was shown in FIG. 3*a* and FIGS. 3*b* through 3*d* results in a porous sintered wire rod 54 of step 110 of FIG. 8. The following step 112 results in parting the porous sintered rod 54 into a plurality of individual porous disks 52. These disks may be further shaped to fit the required profiles shown in FIGS. 7*a* and 7*b*, or any other target shape as required, and in step 114 a high thermal conductivity material is introduced into the pores of the disks 52. The conductive disk is then bonded to the target in step 116, resulting in the structures shown in FIGS. 7*a* and 7*b*. Alternatively, the pores may be used to provide enhanced bonding of the target material to the substrate. The resulting sintered copper target may then be used in any of the prior art devices with increased thermal performance.

Other thermally conductive materials other than copper may be infused into the pores of the anode. Graphite may be introduced into the pores by pyrolytic decomposition of a hydrocarbon gas using chemical vapor deposition (CVD). The porous anode to be infused with graphite is placed in a vacuum chamber containing a partial pressure of a hydrocarbon gas such as CH4 (methane) in an oxygen-free environment. The porous sintered wire anode is heated to 1150 to 1250 degrees C., and the gaseous methane, which has penetrated the porosity, is decomposed to hydrogen and a graphitic form of carbon which deposits in the pores and all over the material to be coated. This CVD process may therein be used to make any form of pyrolytic graphite, and other hydrocarbon gasses may be used in place of methane.

We claim:

1. An x-ray target comprising a substrate and a surface, the surface formed from:

a plurality of wires, each said wire being formed from a homogeneous mixture of one or more materials and having a substantially circular cross section, said plurality of wires sintered into a porous rod having substantially continuous elongate openings proximal to said wires, said elongate openings forming pores with an initial area, said sintering comprising placing said wires in close proximity and under elevated temperature and pressure until said pores initial area is reduced;

said pores thereafter substantially filled with a material having a higher thermal conductivity than said wires, said pores filled after said sintering.

2. The sintered wire target of claim 1 where said wires are formed from at least one of the elements tungsten, molybdenum, tantalum, or niobium.

3. The sintered wire target of claim 1 where said wires are formed from an alloy containing at least one of tungsten, molybdenum, tantalum, or niobium.

4. The sintered wire target of claim 1 where said high thermal conductivity material is at least one of the materials copper, silver, gold, or graphite.

5. An x-ray tube, comprising:

a cathode including a thermionic heater generating a source of high energy electrons;

an anode having an impact area for said high energy electrons, said anode at a positive voltage potential with reference to said cathode;

said anode impact area formed from a sintered wire target, the sintered wire target having:

a plurality of sintered wires formed from a material with a high atomic number, the sintered wires having continuous pores which form openings that are elongate to and proximal to said wires;

said wires having a cross section after sintering which includes said continuous pores proximal to said wires, said wires formed from a substantially homogeneous mixture of one or more said high atomic number materials;

said continuous pores substantially filled with a material having a higher thermal conductivity than said wires.

6. The device of claim 5, whereby said material with a high atomic number includes at least one of the materials tungsten, molybdenum, tantalum, or niobium.

7. The device of claim 5, whereby said material with a high thermal conductivity is at least one of the materials copper, silver, gold, or graphite.

8. The device of claim 5, whereby said anode is stationary with respect to said incoming electrons.

9. The device of claim 5, whereby said anode rotates with respect to said incoming electrons.

10. A target for an x-ray tube, the target receiving a stream of electrons from an electron source, said target formed from a plurality of high atomic weight wires, each said wire having a substantially circular cross section, each said wire formed from a substantially homogeneous material, said wires thereafter sintered together under elevated temperature and pressure, and after said sintering, interposing a thermally conductive material between said sintered wires, the voids between said plurality of wires forming pores having an initial area, said sintering resulting in the reduction of said pores initial area.

11. The device of claim 10, whereby said material with a high atomic number includes at least one of the materials tungsten, molybdenum, tantalum, or niobium.

12. The device of claim 10, whereby said thermally conductive material is at least one of the materials copper, silver, gold, or graphite.

13. The device of claim 10, whereby said target is stationary with respect to said stream of electrons.

14. The device of claim 10, whereby said target rotates with respect to said stream of electrons.

* * * * *

UNITED STATES PATENT AND TRADEMARK OFFICE

CERTIFICATE OF CORRECTION

PATENT NO. : 7,313,226 B1
APPLICATION NO. : 11/226659
DATED : December 25, 2007
INVENTOR(S) : Falce et al.

It is certified that error appears in the above-identified patent and that said Letters Patent is hereby corrected as shown below:

Title page, item [54]
The title "Sintered Wire Annode" should be changed to --Sintered Wire Anode--

Column 4 line 26 "the start of" should be changed to --the state of--

Column 5 line 25 "matrix the" should be changed to --matrix, the--

Signed and Sealed this

Sixth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 7,313,226 B1
APPLICATION NO. : 11/226659
DATED : December 25, 2007
INVENTOR(S) : Falce et al.

It is certified that error appears in the above-identified patent and that said Letters Patent is hereby corrected as shown below:

Title page, item [54] and Column 1, line 1
The title "Sintered Wire Annode" should be changed to --Sintered Wire Anode--

Column 4 line 26 "the start of" should be changed to --the state of--

Column 5 line 25 "matrix the" should be changed to --matrix, the--

This certificate supersedes the Certificate of Correction issued January 6, 2009.

Signed and Sealed this

Third Day of February, 2009

John Doll

JOHN DOLL
*Acting Director of the United States Patent and Trademark Office*